US012612794B1

(12) United States Patent
Goff et al.

(10) Patent No.: US 12,612,794 B1
(45) Date of Patent: Apr. 28, 2026

(54) PORTABLE ROOFTOP GUARDRAIL ASSEMBLY

(71) Applicant: USA Corporate Holding, Inc, Sarasota, FL (US)

(72) Inventors: James E. Goff, Sarasota, FL (US); Joeseph Rogers, Sarasota, FL (US); Eric Lodwick, Sarasota, FL (US); Talon Zieschang, Sarasota, FL (US); Russell Hindman, Sarasota, FL (US); Anthony Eldridge, Sarasota, FL (US); Kelvin Casillas, Sarasota, FL (US); Luke Drazek, Sarasota, FL (US)

(73) Assignee: USA Corporate Holding, Inc., Sarasota, FL (US)

( * ) Notice: Subject to any disclaimer, the term of this patent is extended or adjusted under 35 U.S.C. 154(b) by 0 days.

(21) Appl. No.: 18/779,488

(22) Filed: Jul. 22, 2024

(51) Int. Cl.
*E04G 21/32* (2006.01)

(52) U.S. Cl.
CPC ..... *E04G 21/3233* (2013.01)

(58) Field of Classification Search
CPC ..... E04G 21/3233; E04F 11/181; E04F 11/1834; E04F 11/1817; E04F 2011/1821; E04F 2011/1819; E04F 2011/1827; E04H 17/1447; E04H 17/1417; E04H 17/1448; E04H 17/1452; E04H 17/1488; E04H 17/146

(Continued)

(56) References Cited

U.S. PATENT DOCUMENTS 3,480,257 A * 11/1969 Bourn ..... E04G 5/045 182/113
3,589,682 A * 6/1971 Dickey ..... E04G 21/3233 256/65.1

(Continued)

OTHER PUBLICATIONS

Peterson, Information About Railing Requirements for Roof Hatch Fall Protection, 2023 Activar Construction Products Group, Inc., pp. 1-4.

(Continued)

*Primary Examiner* — Colleen M Chavchavadze
*Assistant Examiner* — Shiref M Mekhaeil
(74) *Attorney, Agent, or Firm* — Anton J. Hopen; Trenam Law

(57) ABSTRACT

The invention relates to a portable rooftop guardrail apparatus designed for efficient transportation and deployment on rooftops accessed through narrow hatches. The system comprises modular components, including vertical support members, lateral retaining rails, and adjustment rails, fabricated from hollow structural cross-sections. A reversible, self-closing gate assembly features a U-shaped extension and a receiver for adjustable closure. Each element is dimensioned for ease of passage through standard hatch dimensions, facilitating internal transport and rooftop assembly without the need for external lifting equipment. Optimized for rapid deployment and versatility, the apparatus complies with stringent safety standards and is engineered to withstand high wind loads. This configuration offers a scalable solution for enhancing worker safety in (Continued)

various rooftop environments, circumventing the need for permanent installations and reducing dependence on heavy machinery.

12 Claims, 3 Drawing Sheets

(58) Field of Classification Search
USPC ..... 182/113; 256/59, 65.01, 65.02, 65.08, 256/65.11, 65.12, 67
See application file for complete search history.

(56) References Cited

U.S. PATENT DOCUMENTS 3,752,262 A * 8/1973 Helms ..... E04G 5/14 182/178.1
3,867,997 A * 2/1975 Hyslop, Jr. ..... E04G 5/14 256/65.05
3,881,698 A * 5/1975 Marsh ..... E04G 21/3233 248/231.41
3,920,221 A * 11/1975 Berry ..... E04G 21/3233 52/707
3,995,833 A * 12/1976 McLaughlin ..... E04G 21/3242 256/65.14
4,666,131 A * 5/1987 Kettelkamp, Sr. ..... E04G 5/041 182/113
4,669,577 A * 6/1987 Werner ..... E04G 21/3242 248/231.71
4,821,844 A * 4/1989 Huffman ..... E04G 5/061 248/235
5,145,153 A * 9/1992 Glynn ..... E04G 21/3238 248/162.1
5,269,394 A * 12/1993 Haroldson, Sr. ..... E04G 7/28 248/231.51
5,314,167 A * 5/1994 Holloman ..... E04G 21/3233 182/113
5,456,451 A * 10/1995 Eyler, Jr. ..... E04G 21/3223 256/65.06
5,573,227 A * 11/1996 Hemauer ..... E04G 21/3214 256/65.06
5,718,305 A * 2/1998 Palmer ..... E04G 21/3261 182/45
5,842,685 A * 12/1998 Purvis ..... E04G 21/3223 182/113
6,038,829 A * 3/2000 Franks ..... E04G 21/3242 52/645
6,039,150 A * 3/2000 Palmer ..... E04G 21/3223 182/113
6,220,577 B1 * 4/2001 Ostrow ..... E04G 21/3223 256/DIG. 1
6,681,528 B1 * 1/2004 Profeta ..... E04D 13/0335 52/72
6,688,046 B2 * 2/2004 Perkins ..... E02D 29/127 256/65.01
6,931,793 B2 * 8/2005 Joyce ..... E04D 13/0315 182/112
7,234,689 B2 * 6/2007 Kuenzel ..... E04G 21/3233 182/113
RE39,842 E * 9/2007 Purvis ..... E04G 21/3223 182/113
7,516,575 B2 * 4/2009 Cuccurullo ..... E04G 21/3204 52/200
7,523,921 B2 * 4/2009 Garrity ..... E04H 17/17 256/26
8,132,792 B2 * 3/2012 Perris ..... E04G 21/3223 182/113
8,448,923 B1 * 5/2013 Schad ..... E04G 21/3219 256/65.03
8,522,487 B2 * 9/2013 Whiting ..... E05C 1/14 52/72
8,596,015 B2 * 12/2013 Coon ..... E05B 73/00 52/645
9,045,906 B1 * 6/2015 Richey ..... E04D 13/0357
10,689,866 B2 * 6/2020 Baca ..... E04G 5/14
10,947,732 B2 * 3/2021 Rabin ..... E04D 13/0335
11,007,832 B1 * 5/2021 Rebick ..... B60D 1/52
11,203,880 B2 * 12/2021 Baca ..... E04G 5/14
11,236,511 B2 * 2/2022 Henderson ..... E04H 17/20
11,761,217 B2 * 9/2023 Curtis ..... E04G 5/145 182/113
2002/0096673 A1 * 7/2002 Siel ..... E04H 17/18 256/67
2003/0020253 A1 * 1/2003 Albert Bosman ..... B60R 3/005 280/164.1
2003/0132427 A1 * 7/2003 Allenbaugh ..... E04G 21/3233 256/65.14
2004/0154241 A1 * 8/2004 Joyce ..... E04D 13/0315 52/200
2007/0246299 A1 * 10/2007 Wright ..... E04G 21/3242 182/113
2008/0028694 A1 * 2/2008 Wasitis ..... E04G 21/3261 52/127.4
2009/0127534 A1 * 5/2009 Powell ..... E04G 21/3233 256/65.02
2010/0264390 A1 * 10/2010 Cerda ..... E04G 5/142 29/428
2011/0017967 A1 * 1/2011 Whiting ..... E06C 7/006 256/59
2013/0119651 A1 * 5/2013 Conny ..... B60R 3/005 248/214
2013/0219790 A1 * 8/2013 Honeycutt ..... E06B 11/04 49/176
2014/0217346 A1 * 8/2014 Cullen ..... E04D 13/0335 256/65.01
2017/0101297 A1 * 4/2017 Claypool ..... B60M 1/28
2018/0016801 A1 * 1/2018 Davis ..... G09F 17/00
2018/0023310 A1 * 1/2018 Smith ..... E04G 21/3233 182/112
2018/0112413 A1 * 4/2018 Palasek ..... E04H 17/1413
2018/0127993 A1 * 5/2018 Baca ..... E04G 5/14
2020/0318369 A1 * 10/2020 Baca ..... E04G 21/3233
2021/0189759 A1 * 6/2021 Rainville ..... E04G 21/3233

OTHER PUBLICATIONS

How Big Does a Roof Hatch Need to Be?, Best Roof Hatches, accessed on Jul. 5, 20204 at https://bestroofhatches.com/blog/how-big-does-a-roof-hatch-need-to-be/#:~:text=Here are the industry-standard, by 30 inches for ladder.
IBC, OSHA Hatch and Roof Access Ladder Code Requirements, 2024 Lapeyre Stair Inc., accessed Jul. 5, 2024 at https://www.lapeyrestair.com/blog/unoccupied-roof-egress-requirements/#:~:text=OSHA roof access hatch requirements,—To meet the&text=For stairw . . . .
Kee Dome Non-Penetrating Hatch Guardrail, 2024 Simplified Safety, Inc., accessed on Jul. 5, 2024 at https://simplifiedsafety.com/safety-railing/kee-dome-non-penetrating-hatch-guardrail-60/.
Occupational Safety and Health Admin., Labor, OSHA standards, CFR 2018, 29 CFR Ch. XVII (Jul. 1, 2018 Edition), pp. 1-7.
Why Fall Protection for Roof Hatches is Critical, 2024 Simplified Safety, Inc., accessed on Jul. 5, 2024 at https://simplifiedsafety.com/blog/do-i-need-a-railing-for-my-roof-hatch/.

* cited by examiner

PORTABLE ROOFTOP GUARDRAIL ASSEMBLY

BACKGROUND OF THE INVENTION

1. Field of the Invention

The described embodiments relate generally to safety equipment. Specifically, the described embodiments relate to systems and methods for portable and adjustable guardrails used in industrial and commercial settings to provide safety barriers on rooftops.

2. Description of the Related Art

Safety guardrails are essential in industrial and commercial environments to prevent falls and accidents, especially on rooftops where maintenance and inspections are frequent. The Occupational Safety and Health Administration (OSHA) has established stringent regulations to ensure the safety of workers accessing these areas. However, current rooftop guardrail systems face significant challenges due to the size and design constraints of standard rooftop hatches.

Current State of the Art

Existing rooftop guardrail systems are designed to provide comprehensive fall protection around rooftop perimeters and access points. These systems typically include vertical support posts, horizontal rails, and various connectors and bases to ensure stability and adaptability to different rooftop configurations. While these systems are effective in preventing falls, they are often bulky and difficult to transport, especially to rooftops that are accessed via narrow ladders and hatches. Existing systems use 1.5" galvanized or coated steel pipe. This is expensive, heavy and requires additional heavy couplings like 90-degree elbows.

OSHA Regulations and Rooftop Hatch Dimensions

OSHA has set forth specific standards regarding the design and dimensions of rooftop hatches to ensure safe access. According to OSHA standard 1910.23(d)(13)(ii), the minimum perpendicular distance from the centerline of the steps or rungs to the nearest object on the climbing side must be 30 inches (76 cm). However, when unavoidable obstructions are encountered, this minimum clearance can be reduced to 24 inches (61 cm), provided deflector plates are installed. This regulation ensures that even in constrained spaces, workers have sufficient room to maneuver safely.

Additionally, the International Building Code (IBC) and OSHA guidelines indicate that the industry-standard size for a roof hatch accessed by a ladder is typically 36 by 30 inches. This size is designed to accommodate a worker carrying tools and equipment while maintaining safety during access. However, these dimensions also present a significant limitation when transporting large and bulky guardrail systems.

Challenges with Existing Rooftop Guardrail Systems

A significant challenge with current rooftop guardrail systems is their inability to be easily transported through the narrow dimensions of standard rooftop hatches. These systems are often large and cumbersome, making it difficult for workers to carry them through confined spaces. As a result, these guardrail systems must be either pulled up the side of the building or delivered to the rooftop using expensive crane services.

Transporting guardrail systems up the side of a building poses significant safety risks. Workers must maneuver the equipment while climbing ladders or using hoists, increasing the likelihood of accidents and injuries. Moreover, the process is labor-intensive and time-consuming, often requiring additional personnel and specialized equipment.

Crane delivery, while safer, is associated with high costs and logistical challenges. Coordinating crane services involves significant planning and scheduling, which can delay maintenance and inspection tasks. Additionally, cranes may not always be accessible, especially in densely populated urban areas or buildings with restricted access.

Moreover, many existing solutions, even if they could theoretically be transported up a ladder in smaller segments, require physical attachment to the rooftop structure. This need for drilling or bolting can be problematic in situations where roof integrity must be preserved or where modifications are not permitted. Furthermore, these systems are not universally adaptable, often tailored to specific hatch sizes and configurations, which limits their applicability and requires site-specific customization.

Some non-penetrating guardrail systems exist, such as those constructed of galvanized steel pipes. These systems do not require drilling into the roof structure, thus preserving roof integrity. However, these systems are not adjustable. They come in fixed lengths, which means that construction entities must maintain numerous variations and lengths of galvanized pipes to fit different rooftop configurations. This lack of adjustability makes these systems less versatile and often considered temporary solutions. The fixed length of the pipes also requires precise measurements and customization for each application, leading to inefficiencies and increased costs.

Given the limitations of current guardrail systems, there is a clear need for a portable and adjustable rooftop guardrail system that can be easily transported through the narrow dimensions of standard rooftop hatches. Such a system would significantly enhance worker safety and efficiency by allowing the guardrail components to be carried in a compact, disassembled state through the interior of the building, up ladders, and through hatches without the need for crane services or risky external hoisting.

A portable and adjustable guardrail system would address several critical needs. First, enhanced safety is achieved by allowing workers to transport the guardrail system through the building's interior, minimizing the risk of accidents and injuries associated with external hoisting and climbing. Second, cost efficiency is realized by eliminating the need for crane services, reducing the overall cost of installation and maintenance. The ability to quickly and easily transport the system to the rooftop also reduces labor costs. Third, flexibility and adaptability are ensured by a modular and adjustable design that allows the guardrail system to be configured to fit various rooftop layouts and dimensions, providing comprehensive fall protection regardless of the rooftop's specific characteristics. Finally, ease of installation is achieved by a system that can be quickly assembled and disassembled on-site, enhancing operational efficiency and allowing maintenance tasks to be completed more swiftly and with less disruption.

Many industries require regular rooftop access, including telecommunications, HVAC maintenance, building inspections, and solar panel installation and maintenance. Companies with employees accessing roofs on thousands of buildings across the country every year would find a portable solution extremely beneficial. The ability to transport guardrail systems easily through buildings, avoiding the need for cranes, would result in significant cost savings and enhanced safety.

Telecommunications companies, for example, often have equipment installed on rooftops and require frequent maintenance. A portable guardrail system that can be carried up a ladder in a backpack and quickly assembled on the rooftop would streamline operations and enhance worker safety. Similarly, HVAC technicians, who frequently access rooftop units for maintenance and repairs, would benefit from a guardrail system that can be easily transported and set up without the need for specialized lifting equipment.

The ability to quickly deploy guardrail systems in response to immediate safety needs is another significant advantage. For instance, if a rooftop hatch is temporarily exposed due to maintenance activities, a portable guardrail system can be rapidly assembled to provide fall protection, ensuring compliance with OSHA regulations and preventing accidents.

The current state of rooftop guardrail systems presents significant challenges in terms of portability and ease of transport through narrow rooftop hatches. OSHA regulations allow for rooftop hatch dimensions as small as 30 inches, and in some cases, even 24 inches, which makes it impractical to transport existing guardrail systems through these confined spaces. Consequently, there is a pressing need for an innovative solution that addresses these challenges, providing a portable and adjustable guardrail system that can be easily transported and assembled on-site.

The development of such a system would not only enhance worker safety and reduce installation costs but also offer greater flexibility and adaptability for various rooftop configurations. By aligning with OSHA and IBC standards and addressing the practical constraints of rooftop access, a portable and adjustable guardrail system represents a significant advancement in rooftop safety equipment. The ability to transport, assemble, and adjust the guardrail system quickly and efficiently would meet the needs of various industries, providing a versatile and reliable solution for fall protection on rooftops.

BRIEF SUMMARY OF THE INVENTION

The portable rooftop guardrail apparatus provides an effective safety solution for various rooftop environments, emphasizing ease of transport, quick installation, and robust performance under significant environmental stresses, including high wind loads. This apparatus consists of several key components designed to work together seamlessly: modular square tubular vertical support members, horizontal retaining rails, adjustable connection mechanisms, and a self-closing safety gate. Each component is engineered to ensure maximum safety and compliance with regulatory standards, making the system suitable for both temporary and permanent installations on rooftops.

As noted supra, the standard in guardrail systems is to use 1.5" coated or galvanized steel pipe. This is expensive, heavy and thus costly in both material and labor. What was needed in the art was a light, compact, efficient but highly resilient guardrail apparatus with greater adjustability to accommodate obstacles and variations in structures. However, while this was not believed to be feasible outside the traditional construction, the present inventors developed and validated a novel and non-obvious apparatus to meet these long-felt needs. The apparatus disclosed and claimed herein proved unexpectedly resilient in a RISA-3D Version 22 structural analysis based upon an ultimate wind speed of 180 miles per hour (see Table 1).

TABLE 1

| Member Name | Member Shape | Wind load (plf) | Wind Load Ice (plf) | Weight Ice (plf) | Bending Check | Shear Check | Total Capacity |
|---|---|---|---|---|---|---|---|
| Post 2 (20) | HSS2X2X2 | 30.43 | 6.01 | 1.43 | 80.10% | 8.80% | 80.10% |
| Rail 2 (34) | HSS2X2X2 | 30.43 | 6.01 | 1.43 | 35.40% | 12.30% | 35.40% |
| Rail 1.5 (38) | HSS1.5X1.5 X1/8 | 22.82 | 4.51 | 1.32 | 19.90% | 19.90% | 19.90% |
| Pipe 1.0 (52) | PIPE_1.0 | 20.01 | 3.95 | 1.28 | 17.30% | 3.90% | 17.30% |
| Pipe 0.75 (50) | PIPE_.75 | 15.98 | 3.16 | 1.22 | 32.40% | 6.40% | 32.40% |
| Plate (22) | 3"X0.25" PLATE | 45.64 | 9.02 | 1.66 | 28.50% | 14.00% | 28.50% |

Central to the guardrail system are the modular square tubular vertical support members. Each support member is at least 3.5 feet in height, constructed from hollow structural sections (HSS) measuring 2 inches by 2 inches, providing substantial strength and resistance to environmental stresses. These support members feature a lateral square support plate at their base, designed to engage directly with the rooftop surface. The support plate includes multiple apertures, each at least 1/16, preferably ½ inch in diameter, allowing for the optional use of penetrative roof-mounting screws. This design feature offers flexibility in the installation process, enabling secure attachment to various roof types without requiring significant structural modifications.

Each vertical support member is designed with multiple apertures to accommodate rail-securing systems. Specifically, each member includes at least one upper rail-securing aperture located distally from the support plate and at least one middle rail-securing aperture positioned approximately midway along the length of the member. Both sets of apertures are oriented in a first direction, allowing for the sliding insertion of U-bolts. These U-bolts, once inserted through the tubular cross-section of the vertical support member, are secured with corresponding locking nuts, providing a stable and reliable connection for the horizontal rails. This configuration is crucial for maintaining the structural integrity of the guardrail system, ensuring the horizontal rails remain securely fastened.

In addition to the rail-securing apertures, the vertical support members incorporate gate-securing apertures. These are strategically positioned near the upper and middle rail-securing apertures but oriented in a second direction perpendicular to the first. This perpendicular orientation allows for the secure attachment of the gate support mechanisms. Specifically, each vertical support member includes a first set of gate-securing apertures located proximate to the upper rail-securing apertures and a second set of gate-securing apertures near the middle rail-securing apertures. These apertures are designed to receive U-bolts, which, when secured with locking nuts, provide a robust framework for the installation and stability of the gate within the guardrail system. It is important to note that the system is modular so that any vertical support member can also couple to a gate support assembly. This facilitates assembly, inventory management and lowers manufacturing costs by reducing the number of different parts required.

The horizontal rails, essential for forming the continuous barrier of the guardrail system, are uniform modular square tubular lateral retaining rails. Each retaining rail has a closed end secured by either the upper or middle rail retaining bolts of the vertical support members. These rails are oriented horizontally, aligning with the vertical support members to create a stable and secure guardrail structure. The open end of each retaining rail, distal to the closed end, includes multiple bolt-receiving apertures. This design feature facilitates the connection of additional rails or safety components, enabling the extension or adjustment of the guardrail system as required.

To enhance the system's adaptability, it includes square tubular adjustment rails, each featuring a series of substantially equidistant apertures throughout their tubular cross-section. These adjustment rails are designed to be slidably received within the open ends of the lateral retaining rails. This design allows for lateral, telescopic adjustment, forming a top-down, adjustable rectangular perimeter of the entire rooftop guardrail assembly. This adjustability is particularly critical in accommodating various rooftop dimensions and configurations, especially around access hatches. The adjustment rails and retaining rails are securely connected by passing bolts through the apertures in the first side of the open end of each retaining rail, through the cross-section of the adjustment rail, and out through the opposing side. These bolts are then secured with locking nuts, ensuring a robust and reliable assembly that maintains structural integrity even under significant stress.

A key feature of the apparatus is the reversible (left or right opening) self-closing gate assembly, which includes two modular square tubular vertical gate support posts. Each gate support post has a base plate designed for secure placement on the roof and extends upwards, forming an F-shaped structure. This structure includes an upper gate lateral support member and a middle gate lateral support member, each received by corresponding gate support retaining bolts. The gate itself is horizontally adjustable and pivotably affixed to one of the gate support posts, allowing it to close securely against the other post. The gate features a U-shaped round tubular member gate extension that is slidably received by a corresponding tubular member gate receiver. The horizontal adjustment of the gate's width is achieved by placing a bolt through the apertures in the gate extension and gate receiver, allowing for precise control over the gate's dimensions.

The gate extension and gate receiver are specifically designed to ensure both durability and ease of use. The gate extension has an outer diameter of 0.75 inches, while the gate receiver has an outer diameter of 1.0 inch. Both components are made from pipe material, providing the necessary strength and flexibility for the gate mechanism. The gate extension and gate receiver have an assembled vertical height of approximately 21 inches and an unassembled width of about 16 inches. These dimensions ensure that the gate assembly is compact and easily transportable, facilitating its installation and adjustment on various rooftop configurations.

The materials used in the construction of the guardrail system are selected for their durability and compliance with safety standards. The vertical support members, lateral retaining rails, adjustment rails, and gate support posts are constructed from hot rolled steel. This material is known for its strength and durability, making it ideal for safety applications. The hot rolled steel used in these components has a minimum yield strength of 50 ksi (kilo-pound per square inch), a minimum tensile strength of 65 ksi, and an elongation of 21% in 2 inches. These properties ensure that the guardrail system can withstand significant forces and environmental conditions without compromising safety.

The square tube members used in the guardrail system are constructed from ASTM A500 Grade B rectangular tube steel. This material is specifically chosen for its high strength and durability, with a minimum yield strength of 46 ksi and a minimum tensile strength of 58 ksi. The pipe-cross section members of the gate assembly are made from ASTM A53 Grade B steel, which has a minimum yield strength of 35 ksi, a minimum tensile strength of 60 ksi, and an elongation of 25% in 2 inches. The support plates used in the vertical support members are made from ASTM A36 Grade 36 steel, exhibiting a minimum yield strength of 36 ksi and a minimum tensile strength of 58 ksi. This comprehensive selection of materials ensures that the guardrail apparatus is not only strong and durable but also compliant with stringent industry standards.

The design of the guardrail system adheres to the 2021 International Building Code and ASCE/SEI 7-16 standards, which dictate the structural requirements necessary to withstand an ultimate wind speed of 180 mph. This capability is particularly important in ensuring the safety of the system in high-risk, exposed environments. Compliance with these standards, coupled with the system's adherence to OSHA's Section 1926.502 (b)—Guardrail Systems, underscores its reliability and safety efficacy.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
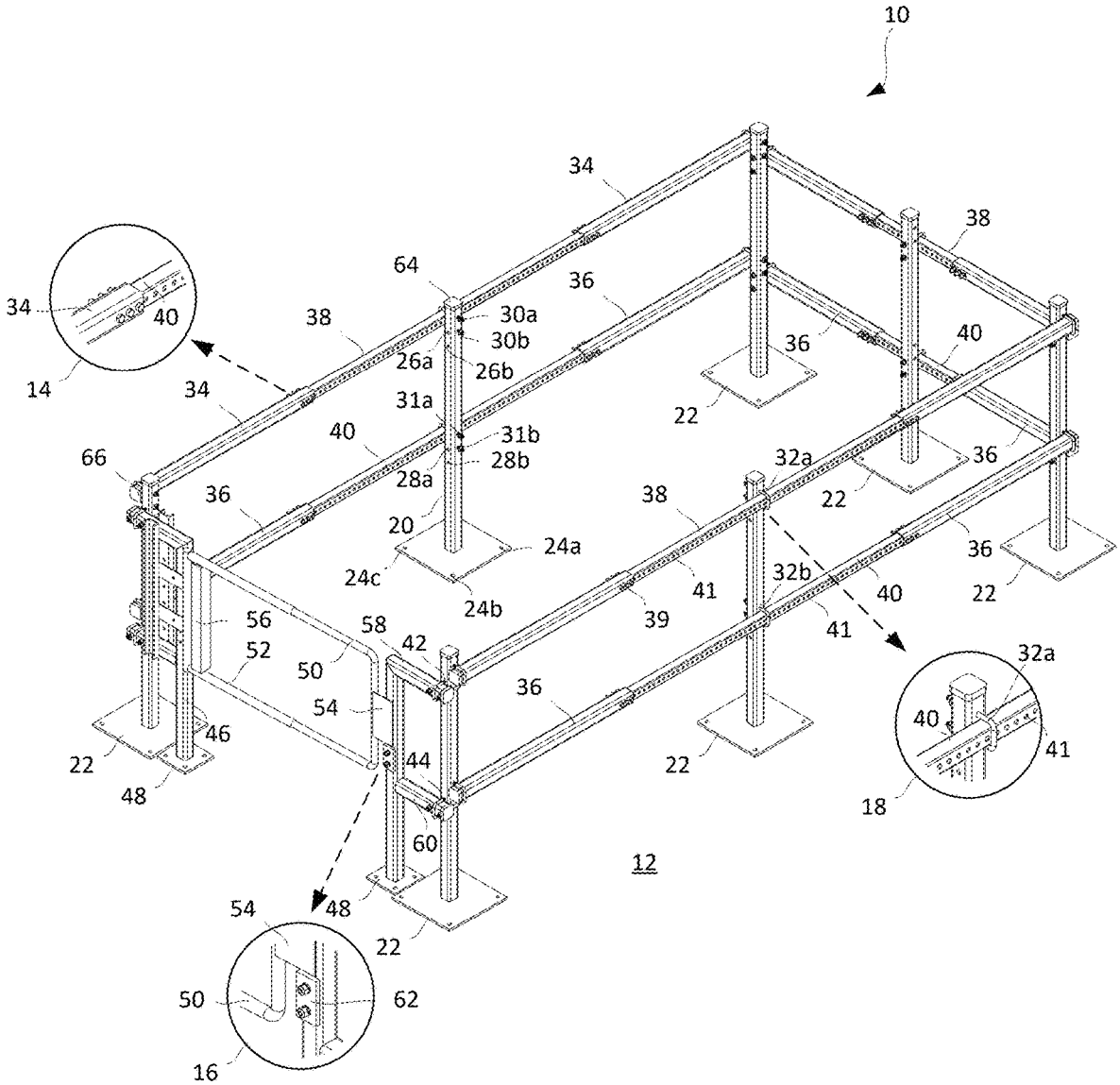
FIG. 1 is an isometric view of an embodiment of the invention including additional close-up views.
Figure 2:
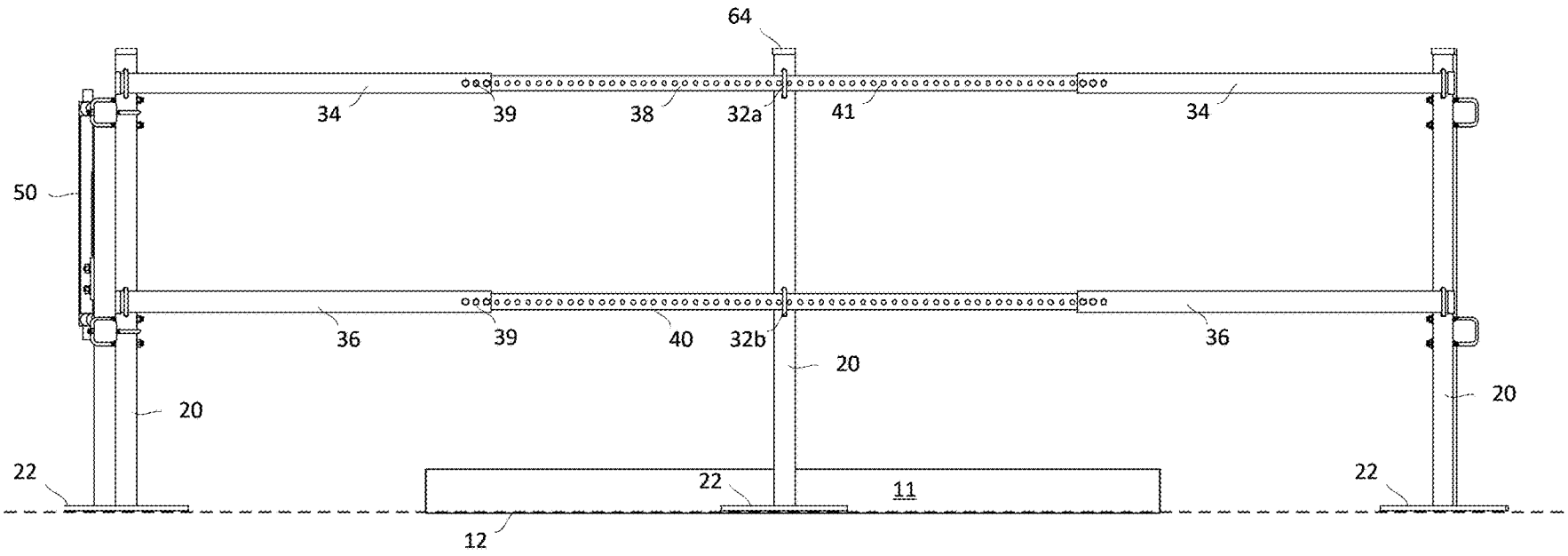
FIG. 2 is a side elevation view of an embodiment of the invention.
Figure 3:
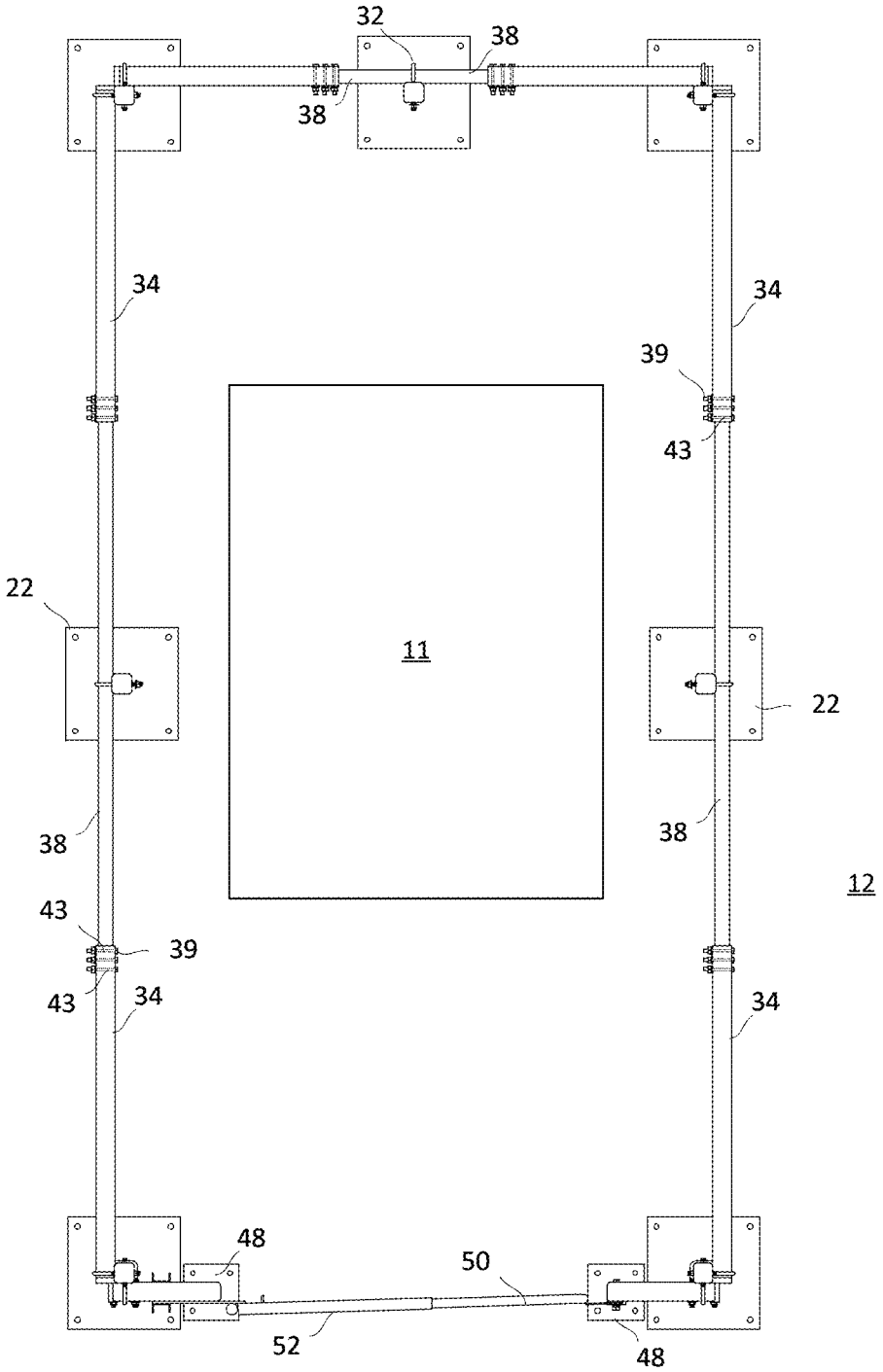
FIG. 3 is a top-down view of an embodiment of the invention.

The present invention relates to a portable rooftop guardrail apparatus, referenced generally as the apparatus 10, which is designed to provide safety and fall protection on various rooftop environments. The apparatus 10 is engineered to be easily transportable, quickly assembled, and highly durable, even in high-wind conditions. It is particularly useful for creating safety perimeters around rooftop access hatches 11 on roof decks 12, as depicted in FIG. 1, FIG. 2, and FIG. 3.

The apparatus denoted as a whole as reference numeral 10 includes a plurality of uniform modular square tubular vertical supports 20. Each vertical support member 20 is at least 3.5 feet in height and features a lateral square support plate 22 at its base, which engages directly with the rooftop surface. The square support plates 22, shown in the figures, have multiple apertures 24*a-c*, allowing for the optional use of penetrative roof-mounting screws. Industrial adhesive may be used in conjunction or as an alternative to penetrating hardware. This design feature provides flexibility in the installation process, enabling secure attachment to various roof types without requiring significant structural modifications.

The vertical support members 20 are equipped with multiple sets of apertures designed to accommodate rail-securing systems. Specifically, each vertical support member 20 includes a first upper rail-securing aperture 30*a-b*, located distally from the support plate 22, and a second middle rail-securing aperture 31*a-b*, positioned approximately midway along the length of the member. Both sets of apertures 30*a-b* and 31*a-b* are oriented in a first direction, allowing for the sliding insertion of securing hardware, for example U-bolts 32*a-b*, as illustrated in FIG. 1 and FIG. 2. 32*a* being an upper rail retaining bolt and 32*b* a middle rail retaining bolt. Once inserted through the tubular cross-section of the vertical support member 20, U-bolts 32*a-b* are secured with corresponding locking nuts, providing a stable and reliable connection for the horizontal rails 34 and 36.

Additionally, the vertical support members 20 include gate-securing apertures 26*a-b* and 28*a-b*, strategically positioned near the upper and middle rail-securing apertures but oriented in a second direction perpendicular to the first. This perpendicular orientation allows for the secure attachment of the gate support mechanisms on one side and retaining rails on the other side. Specifically, each vertical support member 20 includes a third aperture 26*a-b* located proximate to the first upper rail-securing apertures 30*a-b*, and a fourth aperture 28*a-b* near the middle rail-securing apertures 31*a-b*. These apertures 26*a-b* and 28*a-b* are designed to receive U-bolts, which, when secured with locking nuts, provide a robust framework for the installation and stability of the gate or opposing retaining rails within the guardrail system.

The horizontal rails, essential for forming the continuous barrier of the guardrail system, are uniform modular square tubular lateral retaining rails. These retaining rails include upper retaining rails 34 and middle retaining rails 36. Each retaining rail has a closed end secured by cither the upper rail retaining U-bolt 32 or the middle rail retaining U-bolt 32 from the vertical support members 20. These rails are oriented horizontally, aligning seamlessly with the vertical support members to create a stable and secure guardrail structure, as depicted in FIG. 1 and FIG. 2. The open end of each retaining rail, distal to the closed end, includes multiple bolt-receiving apertures 43 (cross-sections FIG. 3). This design feature facilitates the connection of additional rails or safety components, enabling the extension or adjustment of the guardrail system as required.

To enhance the system's adaptability, it includes square tubular adjustment rails, such as upper adjustment rails 38 and middle adjustment rails 40, each featuring a series of substantially equidistant apertures 41 throughout their tubular cross-section. These adjustment rails 38 and 40 are designed to be slidably received within the open ends of the lateral retaining rails 34 and 36 in telescoping fashion. This unique design allows for lateral, telescopic adjustment, forming a top-down, adjustable rectangular perimeter of the entire rooftop guardrail assembly, particularly useful around access hatches 11 and other roof-top obstructions. The adjustment rails 38 and 40 and retaining rails 34 and 36 are securely connected by passing adjustment bolts 39 through the adjustment bolt-receiving apertures 43 in the first side of the open end of each retaining rail, through the cross-section of the adjustment rail, and out through the opposing side, as shown in FIGS. 1 and 4. These adjustment bolts 39 are then secured with locking nuts, ensuring a robust and reliable assembly that maintains structural integrity even under significant stress.

Another feature of the apparatus 10 is the reversible self-closing gate assembly, depicted in FIG. 1 and FIG. 3. This gate assembly includes two modular square tubular vertical gate support posts 46, each with a base plate 48 for secure placement on the roof in similar fashion to the vertical support member 20. The gate support posts 46 extend upwards, forming an F-shaped structure with an upper gate lateral support member 58 and a middle gate lateral support member 60, each received by corresponding gate support retaining bolts 42 and 44. The gate itself is horizontally adjustable and pivotably affixed to one of the gate support posts 46, allowing it to close securely against the other post. The gate features a U-shaped round tubular member gate extension 50 that is slidably received by a corresponding tubular member gate receiver 52. The horizontal adjustment of the gate's width is achieved by placing a bolt through the apertures in the gate extension 50 and gate receiver 52, allowing for precise control over the gate's dimensions.

The gate extension 50 and gate receiver 52 are specifically designed to ensure both durability and ease of use. The gate extension 50 has an outer diameter of 0.75 inches, while the gate receiver 52 has an outer diameter of 1.0 inch. Both components are made from pipe material, providing the necessary strength and flexibility for the gate mechanism. The gate extension 50 and gate receiver 52 have an assembled vertical height of approximately 21 inches and an unassembled width of about 16 inches. These dimensions ensure that the gate assembly is compact and easily transportable, facilitating its installation and adjustment on various rooftop configurations.

The materials used in the construction of the guardrail system are selected for their durability and compliance with safety standards. The vertical support members 20, lateral retaining rails 34 and 36, adjustment rails 38 and 40, and gate support posts 46 are constructed from hot rolled steel. This material is known for its strength and durability, making it ideal for safety applications. The hot rolled steel used in these components has a minimum yield strength of 50 ksi (kilo-pound per square inch), a minimum tensile strength of 65 ksi, and an elongation of 21% in 2 inches. These properties ensure that the guardrail system can withstand significant forces and environmental conditions without compromising safety.

The square tube members used in the guardrail system are constructed from ASTM A500 Grade B rectangular tube steel. This material is specifically chosen for its high strength and durability, with a minimum yield strength of 46 ksi and a minimum tensile strength of 58 ksi. The pipe-cross section members of the gate assembly are made from ASTM A53 Grade B steel, which has a minimum yield strength of 35 ksi, a minimum tensile strength of 60 ksi, and an elongation of 25% in 2 inches. The support plates 22 used in the vertical support members 20 are made from ASTM A36 Grade 36 steel, exhibiting a minimum yield strength of 36 ksi and a minimum tensile strength of 58 ksi. This comprehensive selection of materials ensures that the guardrail apparatus is not only strong and durable but also compliant with stringent industry standards.

The design of the guardrail system adheres to the 2021 International Building Code and ASCE/SEI 7-16 standards, which dictate the structural requirements necessary to withstand an ultimate wind speed of 180 mph. This capability is particularly important in ensuring the safety of the system in high-risk, exposed environments. Compliance with these standards, coupled with the system's adherence to OSHA's Section 1926.502(b)—Guardrail Systems, underscores its reliability and safety efficacy.

The system's design has been verified through engineering assessments. For instance, the bolt properties for securing the base plates include a tensile steel strength per bolt of 7,985 lbs and a shear steel strength per bolt of 4,150 lbs, using F1554 Grade 55 steel. The connection type is adhesive, with a rod type of Hilti Hit-Hy 200 and HAS threaded rod embedded to a depth of 2.75 inches in cracked concrete with an assumed strength of 3,000 psi. The nominal pull-out strength per bolt is calculated at 2,760 lbs, and the nominal shear strength per bolt at 5,945 lbs, ensuring robust attachment under stress conditions.

Additionally, the bolt group check for the base plate confirms that the system is adequate to support the applied loads, with a total capacity utilization of 48.3%. This thorough validation process ensures that the guardrail system not only meets but exceeds safety and performance expectations.

The portable rooftop guardrail apparatus, therefore, represents a significant advancement in rooftop safety solutions. Its modular design allows for easy assembly, disassembly, and adjustment, making it versatile for various applications. The materials and engineering ensure long-term durability and compliance with stringent safety standards, providing reliable fall protection in commercial and industrial settings. The incorporation of adjustable features, such as the telescopic adjustment rails and reversible self-closing gate, enhances the system's adaptability to different rooftop configurations and access points. This comprehensive approach to design, combined with rigorous testing and adherence to safety standards, makes this guardrail system a solution to a long-felt but unfulfilled need in modern rooftop safety operations.

Glossary of Claim Terms

Access hatch means an opening or doorway on a rooftop that provides entry and exit to and from the roof area. It typically measures 36 by 30 inches, which is the industry-standard size as per the International Building Code (IBC) and OSHA guidelines, allowing workers to carry tools and equipment safely. This hatch size is specifically designed to accommodate a worker with sufficient room for maneuverability, ensuring safe access even in constrained spaces. The access hatch is a crucial component in rooftop maintenance, inspections, and safety procedures.

Adjustment rails mean uniform modular, square tubular components that are slidably received within the open ends of lateral retaining rails. These rails have a series of substantially equidistant apertures extending through their tubular cross-section, allowing for lateral, telescopic adjustment. This adjustability forms a top-down, adjustable rectangular perimeter of the entire rooftop guardrail assembly, which is particularly useful for accommodating various rooftop dimensions and configurations, especially around access hatches. The adjustment rails are secured by bolts passing through the apertures, ensuring a robust and reliable assembly.

Elongation means the measure of the ductility of a material, indicating how much it can stretch or elongate before breaking. It is expressed as a percentage of the original length of a specimen and is typically measured over a specified gauge length. In the context of the guardrail system, elongation is a critical property of the hot rolled steel used, with an elongation of 21% in 2 inches, ensuring that the material can absorb significant forces and stresses without fracturing, thereby enhancing the safety and durability of the guardrail apparatus.

Gate extension means a U-shaped round tubular member that is part of the self-closing gate assembly. It is designed to be slidably received by a corresponding tubular member gate receiver, allowing for horizontal adjustment of the gate's width. The gate extension has an outer diameter of 0.75 inches and, when assembled with the gate receiver, provides a secure and adjustable closure mechanism for the gate. This extension is essential for ensuring that the gate can be adjusted to fit various opening sizes, enhancing the flexibility and usability of the gate assembly.

Gate receiver means the tubular member that receives the U-shaped gate extension, forming part of the self-closing gate assembly. It has an outer diameter of 1.0 inch and works in conjunction with the gate extension to allow horizontal adjustment of the gate's width. The gate receiver provides the necessary strength and flexibility for the gate mechanism, ensuring a secure and adjustable closure. This component is essential for maintaining the integrity and functionality of the gate, allowing it to fit various opening sizes on the rooftop guardrail system.

Gate support posts mean the vertical supports for the self-closing gate assembly. These posts are modular, square tubular vertical members with a base plate for secure placement on the roof. They extend upward, forming an F-shaped structure that includes upper and middle gate lateral support members received by corresponding gate support retaining bolts. The gate support posts provide the structural framework necessary for the installation and stability of the self-closing gate, ensuring that the gate operates smoothly and securely in conjunction with the rest of the guardrail system.

Hollow structural sections (HSS) mean steel sections that are hollow and typically have a rectangular or square cross-section. In the context of the portable rooftop guardrail apparatus, HSS components are used for the vertical support members, lateral retaining rails, and adjustment rails. These sections provide substantial strength and resistance to environmental stresses while maintaining a lighter weight compared to solid sections. HSS components are preferred for their high strength-to-weight ratio, making them ideal for portable and adjustable safety systems like the rooftop guardrail.

Hot rolled steel means steel that is processed at high temperatures above the recrystallization temperature, which results in a material with improved workability and ductility. This type of steel is used in the construction of the portable rooftop guardrail apparatus for vertical support members, lateral retaining rails, adjustment rails, and gate support posts. The hot rolled steel used has a minimum yield strength of 50 kilo-pound per square inch (ksi), a minimum tensile strength of 65 ksi, and elongation of 21% in 2 inches, ensuring the guardrail system's durability and ability to withstand significant forces.

Kilo-pound per square inch (ksi) means a unit of pressure or stress. It is used to measure the strength of materials, with 1 ksi equating to 1,000 pounds per square inch. In the context of the rooftop guardrail apparatus, ksi is used to describe the yield strength and tensile strength of the materials used. For example, the hot rolled steel in the guardrail system has a minimum yield strength of 50 ksi, indicating the stress level at which the material begins to deform plastically, and a minimum tensile strength of 65 ksi, representing the maximum stress the material can withstand while being stretched or pulled before breaking.

Lateral support plate means the base plate that engages directly with the rooftop surface, providing stability and anchoring for the vertical support members. These plates are square and feature multiple apertures to optionally receive penetrative roof-mounting screws. The design of the lateral support plate ensures that the guardrail system can be securely attached to various roof types without requiring significant structural modifications. This component is critical for maintaining the overall stability and safety of the guardrail system.

Penetrative roof-mounting screws means fasteners that are used to secure the guardrail system's support plates to the rooftop surface. These screws penetrate the roof material, providing a strong and stable attachment. The support plates of the guardrail system have multiple apertures designed to receive these screws, allowing for secure installation on various roof types. The use of penetrative roof-mounting screws ensures that the guardrail system remains firmly in place, even under significant stress or environmental conditions.

Pipe material means the type of material used to construct certain components of the guardrail system, such as the gate extension and gate receiver. These components are made from pipe material with specific outer diameters (0.75 inches for the gate extension and 1.0 inch for the gate receiver), providing the necessary strength and flexibility for the gate mechanism. Pipe material is chosen for its durability and ability to withstand the forces and stresses encountered in a safety system, ensuring reliable performance and longevity.

Retaining rails means the horizontal members of the guardrail system that form the continuous barrier. These uniform modular square tubular rails include upper retaining rails and middle retaining rails. Each retaining rail has a closed end secured by retaining bolts to the vertical support members and an open end with multiple bolt-receiving apertures. The retaining rails are essential for creating a stable and secure guardrail structure, ensuring that the vertical support members are properly aligned and connected, and providing a horizontal barrier to prevent falls.

Rooftop means the top surface of a building or structure where the guardrail system is installed. Rooftops can vary in size, shape, and material, and may include access hatches for maintenance and inspections. The portable rooftop guardrail apparatus is designed to provide safety and fall protection in various rooftop environments, ensuring compliance with safety standards and regulations. The system's components are engineered to be easily transportable and quickly assembled on different rooftop configurations, enhancing worker safety and operational efficiency.

Self-closing gate means a gate that is designed to close automatically after being opened, ensuring continuous safety without requiring manual intervention. The self-closing gate in the rooftop guardrail apparatus includes two vertical gate support posts with an F-shaped structure, an upper and middle gate lateral support member, and a U-shaped gate extension that fits into a gate receiver. The gate is horizontally adjustable and pivotably affixed to one of the support posts, allowing it to close securely against the other post. This design ensures that the gate remains closed when not in use, preventing accidental falls.

Tensile strength means the maximum stress that a material can withstand while being stretched or pulled before breaking. It is a critical property for materials used in safety systems like the rooftop guardrail apparatus. The tensile strength of the hot rolled steel used in the guardrail system is at least 65 ksi, ensuring that the components can handle significant forces without failing. This high tensile strength contributes to the overall durability and reliability of the guardrail system, making it suitable for various rooftop environments and conditions.

U-bolt means a type of fastener in the shape of the letter "U" with threads on both ends. In the context of the rooftop guardrail apparatus, U-bolts are used to secure various components, such as retaining rails and gate support members, to the vertical support members. The U-bolts pass through apertures in the support members and are secured with locking nuts, providing a stable and reliable connection. This fastening method ensures that the guardrail system remains securely assembled, maintaining its structural integrity and safety under stress.

Vertical support member means a key component of the rooftop guardrail apparatus, providing the primary vertical structure for the system. These members are uniform modular square tubular supports, at least 3.5 feet in height, with a lateral square support plate at the base for rooftop engagement. Each vertical support member features multiple apertures for securing rails and gate components with bolts or U-bolts. These supports are constructed from durable materials like hot rolled steel, ensuring they can withstand significant forces and environmental stresses, contributing to the overall stability and safety of the guardrail system.

Yield strength means the amount of stress at which a material begins to deform plastically. Before reaching the yield point, the material will deform elastically and return to its original shape when the applied stress is removed. The yield strength is an important property in the context of the rooftop guardrail apparatus because it indicates the maximum stress that the material can withstand without permanent deformation. For instance, the hot rolled steel used in the guardrail system has a minimum yield strength of 50 ksi, ensuring that the components maintain their integrity under substantial loads and environmental conditions.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. A portable, modular rooftop guardrail system comprising:

a. a plurality of vertical posts, each post including
   i. a square base plate dimensioned to rest on a roof surface, and
   ii. first and second opposed aperture pairs oriented in a first direction and third and fourth opposed aperture pairs oriented in a second direction perpendicular to the first;

b. a set of upper horizontal rails detachably secured to a respective vertical post of the plurality of vertical posts by fasteners passing through the first and third aperture pairs, respectively and a set of middle horizontal rails detachably secured to the respective vertical post of the plurality of vertical posts by fasteners passing through the second and fourth aperture pairs, respectively;

c. a plurality of telescoping upper adjustment rails slidably received within free ends of the upper horizontal rails and a plurality of telescoping middle adjustment rails received within free ends of the middle horizontal rails, the plurality of the upper adjustment rails and the plurality of the middle adjustment rails lockable from sliding by bolts passing through aligned adjustment apertures; and d. a reversible, self-closing gate assembly that closes an access opening defined by the upper and middle horizontal rails and includes:
   i. two vertical gate support posts, each vertical gate support post supports an upper and a middle gate-support bar, and ii. a gate formed by a U-shaped tubular extension telescopically received in a tubular gate receiver;

wherein each component of the system, in an unassembled state, is sized to pass through a rectangular roof-hatch opening measuring 36 inches by 30 inches.

2. The system of claim 1, wherein the plurality of vertical posts consists of seven posts.

3. The system of claim 1, wherein each base plate is square-shaped and has a perimeter of at least 12 inches with an aperture proximate each corner, each aperture having a diameter between 1/16 inch and 1 inch.

4. The system of claim 3, wherein each base plate is fabricated from steel having a minimum yield strength of 36 ksi and a minimum tensile strength of 58 ksi.

5. The system of claim 1, wherein the aperture pairs oriented in the first direction are positioned proximate an upper end of each post and the aperture pairs oriented in the second direction are positioned approximately midway along the post.

6. The system of claim 1, wherein the upper and middle horizontal rails together total twelve rails.

7. The system of claim 1, wherein the diagonal span of the gate formed by the U-shaped tubular extension in its largest configuration does not exceed 46.86 inches.

8. The system of claim 1, wherein each vertical post and each horizontal rail is formed of steel square HSS tubing having nominal outside dimensions of 2 inches by 2 inches.

9. The system of claim 8, wherein the steel square HSS tubing exhibits a minimum yield strength of 46 ksi and a minimum tensile strength of 58 ksi.

10. The system of claim 1, wherein each adjustment rail is formed of steel square HSS tubing having nominal outside dimensions of 1.5 inches by 1.5 inches.

11. The system of claim 1, wherein the vertical posts, horizontal rails, adjustment rails, and gate posts are fabricated from hot-rolled steel.

12. The system of claim 11, wherein the hot-rolled steel exhibits a minimum yield strength of 50 ksi, a minimum tensile strength of 65 ksi, and an elongation of 21 percent in 2 inches.

* * * * *